United States Patent [19]

Kitai

[11] Patent Number: 4,942,834

[45] Date of Patent: Jul. 24, 1990

[54] LOOPER SHIFTING DEVICE IN OVERLOCK SEWING MACHINE

[75] Inventor: Koji Kitai, Tochigi, Japan

[73] Assignee: SSMC Inc., Edison, N.J.

[21] Appl. No.: 361,626

[22] Filed: Jun. 5, 1989

[30] Foreign Application Priority Data

Jul. 2, 1988 [JP] Japan ..... 63-88190[U]

[51] Int. Cl.[5] ..... D05B 61/00

[52] U.S. Cl. ..... 112/199; 112/187; 112/159; 112/80.5

[58] Field of Search ..... 112/80.5, 80.52, 93, 112/154, 159, 162, 166, 167, 172, 197, 199, 200, 202, 222, 224, 227, 262.1, 269.1, 302

[56] References Cited

U.S. PATENT DOCUMENTS

| | | | |
|---|---|---|---|
| 2,851,974 | 9/1958 | Hayes | 112/200 X |
| 2,982,240 | 5/1961 | McCutchen | 112/80.52 |
| 3,203,379 | 8/1965 | Dedmon | 112/80.52 |
| 3,309,900 | 3/1967 | Wünch | 112/80.5 X |
| 3,783,810 | 1/1974 | Marforio | 112/159 |
| 4,011,823 | 3/1977 | Houghton | 112/80.5 |
| 4,237,804 | 12/1980 | Hirayama | 112/199 X |
| 4,649,843 | 3/1987 | Muroi | 112/225 X |
| 4,799,439 | 1/1989 | Koshinaka | 112/168 X |

*Primary Examiner*—Werner H. Schroeder
*Assistant Examiner*—Ismael Izaguirre

[57] ABSTRACT

The present invention relates to a looper shifting device in an overlock sewing machine having an upper looper and a lower looper and capable of looping the end of the cloth by one needle with use of three threads composed of an upper thread (first thread) in a needle, a second thread in the upper looper, and a third thread in the lower looper. A tip end of a guide passage provided at the upper looper is open to a tip end rear portion of a brade of the upper looper and positioned adjacent to a pore. A horn is retractably inserted in the guide passage. A spreader is defined by the tip end of the horn protruded from the opening and tip end rear portion of the upper looper. There is provided at the side of the upper looper a holding device for holding the base portion of the horn.

5 Claims, 3 Drawing Sheets

LOOPER SHIFTING DEVICE IN OVERLOCK SEWING MACHINE

BACKGROUND OF THE INVENTION

1. Field of the Invention:

The present invention relates to a looper shifting device in an overlock sewing machine for looping the end of a cloth.

2. Description of the Prior Art:

There is known a looper shifting device in an overlock sewing machine capable of shifting a looping operation to be carried out by three threads with use of one needle (hereafter referred to as one needle three threads looping operation) to a looping operation to be carried out by two theads with use of one needle (hereafter referrred to as one needdle two threads looping operation) with one touch operation and disclosed in, for example, Japanese Patent Publication No. 60-20031 and Japanese Utility Model Publication No. 63-1984, etc.

These prior art overlock sewing machines comprise an upper looper fixing lever, a spreader having and end supported by the upper looper fixing lever whereby the spreader is turned so that the operative position where the spreader is engaged in the tip end of the upper looper or inoperative position where the spreader is disengaged from the tip end of the upper looper are shifted by one touch operation without detaching the spreader.

However, the prior art looper shifting device in the overlock sewing machine has such drawbacks that firstly, a large space is required since the exposed spreader shall be turned not to hinder the one needle three threads looping operation by one needle, secondly, a quick shifting operation can not be made since a relatively large motion of the fingers is required for the shifting operation between the operation position and the inoperative position in which one needle two threads looping operation can be carried out. Japanese Patent Publication No. 60-20031 discloses a structure to position the spreader by inserting a projection of the spreader into a thread hole of the upper looper so that the spreader can take a stable operative position while Japanese Utility Model Publication No. 63-1984 discloses a structure to position the spreader by inserting the projection of the spreader into a recess of the upper looper so that the spreader can take a stable operation. These accurate positioning operation of the spreader requires a structure of high accuracy which is an obstacle for manufacturing thereof.

SUMMARY OF THE INVENTION

The present invention has been made to solve the drawbacks set forth above.

It is therefore an object of the present invention to provide a looper shifting device in an overlock sewing machine capable of shifting one needle three threads looping operation to one needle two threads looping operation by one touch operation.

To achive the above object, the looper shifting device in an ovelock sewing machine according to the present invention comprises a needle vertically movable and having a thread hole through which an upper thread is threaded, an upper looper movable crossing the transfer direction of a material to be sewn and having a thread hole at a tip end portion thereof through which an upper looper thread is threaded, the upper looper comprising a side wall portion and a blade portion, a lower looper movable swingable in lateral direction and having a thread hole through which a lower looper thread is threaded, whereby the needle, the upper looper thread and the lower looper thread effecting one needle three threads looping operation, characterized in that the looper shifting device further comprising: a guide passage having a tip end open to a base end side rear portion of the blade portion adjacent to the thread hole of the upper looper, a horn retractably inserted into the guide passage, a tip end portion of the horn protruded from the opening and the tip end side rear portion of the upper looper forming the spreader, and a holding means provided at the upper looper for holding the base end portion of the horn.

The above and other objects, features and advantages of the present invention will become more apparent from the following description taken in conjunction with the accompanying drawings.

DESCRIPTION OF A PREFERRED EMBODIMENT

Figure 1:
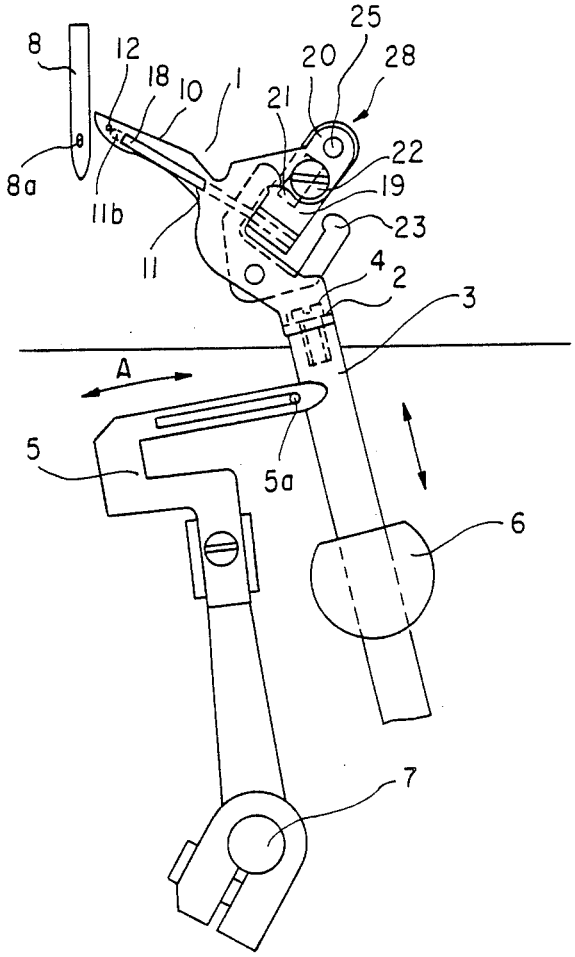
FIG. 1 is a front elevational view showing a loop shifting device in a overlock sewing machine according to a first embodiment of the present invention.

First Embodiment (FIGS. 1 to 6):

A looper shifting device in an overlock sewing machine according to a first embodiment of the present invention will be described with reference to FIGS. 1 to 6.

A looper shifting device comprises an upper looper 1 fixed to an upper end of an upper looper fixing lever 3 by a fixing screw 4 which is inserted into a fixing seat 2, a lower looper 5 having a thread hole 5*a* through which a lower looper thread threads is swingable about a lower looper shaft 7 to move swingably in the direction of the arrow A, and a needle 8 having a thread hole at the lower end thereof through which an upper thread threads moves vertically and lowered accompanied by the leftward swingable motion of the lower looper 5.

The looper fixing lever 3 slidably inserts an upper looper guide 6 rotatably mounted on a front of a frame of the sewing machine and gives the upper looper 1 a predetermined repetitive motion which is operated to cross the transfer direction of the material to be sewn.

The upper looper 1 comprises a side wall portion 9 bent at the front end of the fixing seat 2, a blade portion 10 extending from the side wall portion 9 toward the needle 8 (leftward in the figure) and having a guide passage 11 at the front side of the blade portion 10 which extends from the right base end surface of the side wall portion 9 to the tip end of the blade portion 10, and a bracket portion 20 extending upwardly from the side wall portion 9.

The guide passage 11 guides a flexible horn 18 which is retractably inserted thereinto and has at the tip end thereof a curved portion 11*a* and a tip end side passage 11*b*. The tip end side passage 11*b* extends from the passage 11 via the curved portion 11*a* and open at a base end side rear portion adjacent to a thread hole 12 of the blade portion 10 of the upper blade 1 (upward in FIG. 4) and crosses the thread hole 12 at the space provided at the rear portion of the thread hole 12 which is perforated at the tip end of the blade portion 10. A base end of the curved portion 11*a* connects to a base end side passage 11*c* extending to the longitudinal direction of the blade portion 10. The base end passage has a free end at the front side surface thereof for reducing its weight. The blade portion 10 has at the tip end rear portion thereof a projection 13 and a recess 14 which are extending from the tip end thereof and continuous.

The horn 18 is retractable from the opening of the tip end side passage 11*b* and projected at the tip end thereof at a predetermined length the opening. The tip end projected from the opening and the tip end rear surface of the upper looper 1 form a spreader 24.

The horn 18 may be made of a steel having a diameter of about 1 mm but is preferable to be made of a plastic such as a nylon, a teflon, etc. The reason is that the plastic is superior in a friction coeficient against the sewing thread, conformability, abrasion resistance as well as in elasticity, and easy process.

The base end of the horn 18 projected from the base end side passage 11*c* is held by a holding means 28. That is, the base end of the horn 18 is held by a holder 19. The holder 19 is substantially swingable in the longitudinal direction of the base end side passage 11*c* and swingably supported by a hinge connection set screw 25 screwed into the bracket portion 20 of the upper looper 1. The holder 19 has an elliptic hole 21 which crosses substantially the base end side passage 11*c* while a small diameter eccentric portion 22*a* of an eccentric pin 22 having a large diameter inserted into a through hole 20*a* of the bracket portion 20 is engaged into the elliptic hole 21. The eccentric pin 22 engaged into the elliptic hole 21 is prevented from disengaging from the elliptic hole 21 by a snap ring composed of a C clip 26. The eccentric pin 22 is normally or reversely rotated so that the small diameter eccentric potion 22*a* is eccentrically rotated within the elliptic hole 21 whereby the holder 19 is swingable about the hinge connection set screw 25 to thereby move retractably the horn 18 in the longitudinal direction. A U-shaped positioning means 23 is fixed to the side wall portion 9 at the central portion thereof by a pin 27 which is screwed into a hole provided at the central portion of the positioning means 23 after adjusting the angle to be inclined relative to the side wall portion 9.

The positioning means 23 has an opening open upwardly for receiving a lower end portion of the holder 19. An operative position of the horn 18 is obtained by forward movement of the lower end portion of the holder 19 while a inoperative position of the horn 18 is obtained by backward movement of the lower end portion of the holder 19. The holder 19 is brought into contact with a tip end side inner edge 23*a* of the positioning means 3 to position the operative position of the holder 19 while the holder 19 is brought into contact with a base end side inner edge 23*b* of the positioning means 23 to position the inoperative position of the holder 19.

Both the operative position and the inoperative position can be adjusted to be positioned by adjustment of the angle of inclination of the positioning means 23 relative to the side wall portion 9 which is made by loosening the pin 27.

An operation of the looper shifting device in the overlock sewing machine will be described hereinafter.

Figure 2:
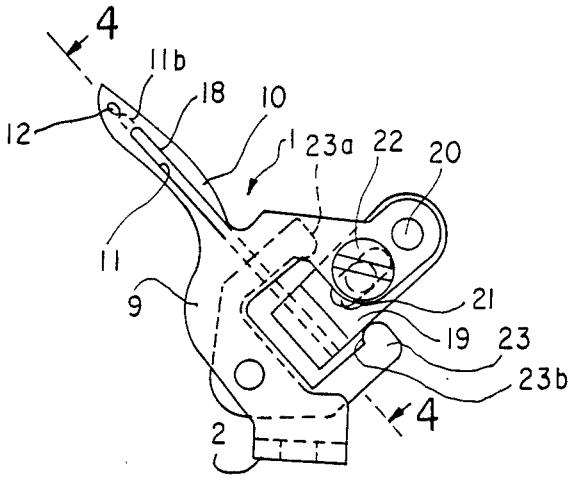
FIG. 2 is a front elevational view of an upper looper at the state where one needle three threads looping operation is carried out.
Figure 3:
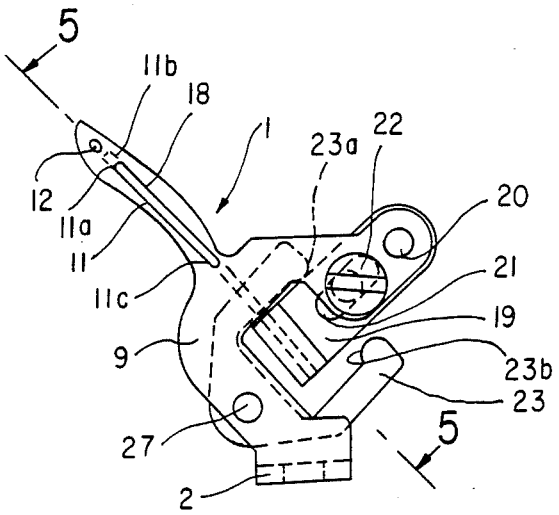
FIG. 3 is a front elevational view of an upper looper at the state where one needle two threads looping operation is carried out.
Figure 4:
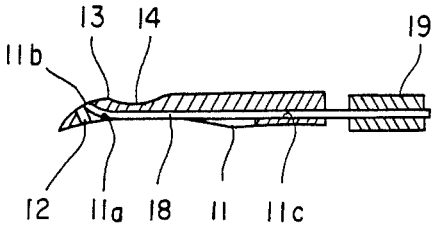
FIG. 4 is a cross sectional view taken along IV—IV of FIG. 2.
Figure 5:
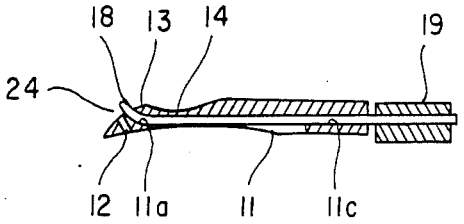
FIG. 5 is a cross sectional view takn along V—V of FIG. 3.
Figure 6:
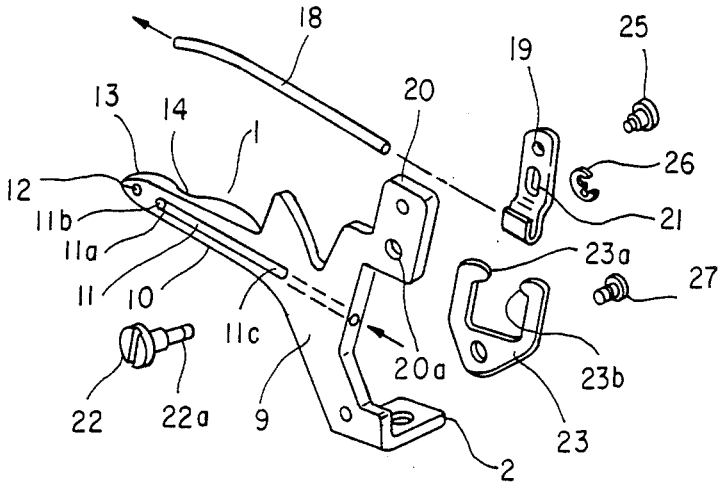
FIG. 6 is an exploded perspective view of the upper looper.

Described first with reference to FIGS. 2 and 4 is the case of one needle three threads looping operation where the needle 8, the upper and the lower loopers are interlocked with each other for looping. The eccentric pin 22 is rotated to bring the holder 19 into contact with the base end inner edge 23*b* of the positioning means 23 for permitting the horn 18 to position the inoperative position so that the tip end of the horn 18 is completely retracted in the tip end side passage 11*b* of the upper looper 1. At this state, one needle three threads looping operation is carried out by the upper thread threaded through the thread hole 8*a* of the needle 8, the upper looper thread threaded through the thread hole 12, and the lower looper thread threaded through the thread hole 5*a* of the lower looper 5.

When the one needle three threads looping operation is changed to one needle two threads looping operation, the eccentric pin 22 is reversely rotated to permit the holder 19 to bring into contact with tip end inner edge 23*a* of the positioning means 23 and to permit the tip end of the horn 18 to protrude for the predetermined length from the opening of the tip end side passage 11*b* of the upper looper 1 while the upper looper thread is taken out from the thread hole 12 of the upper looper 1. At this state, one needle two threads looping operation is effected by the two threads threaded through the thread hole 8*a* of the thread 8 and the thread hole 5*a* of the lower looper 5. Although the holder 19 and the positioning means 23 are respectively attached to the upper looper 1, but they may be fixed to the upper looper fixing lever 3 so that they may be attached to the upper looper fixing lever 3 integrally formed with the upper looper 1.

Figure 7:
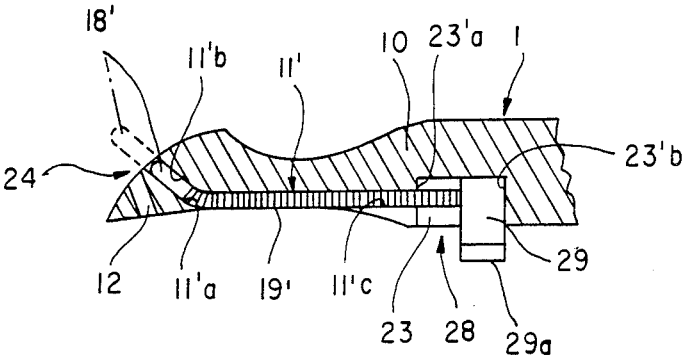
FIG. 7 is a cross sectional view of a main portion of a looper shifting device in an overlock sewing machine accoring to a second embodiment of the present ivention.
Figure 8:
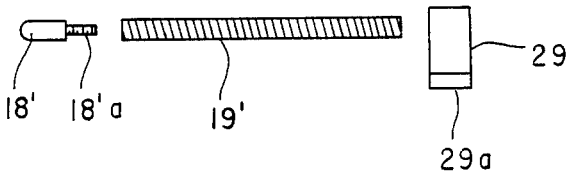
FIG. 8 is an exploded view of assistance in explaining a horn and a holding member of FIG. 7.

Second embodiment (FIGS. 7 and 8):

A looper shifting device in the overlock sewing machine according to a second embodiment of the present invention will be described with reference to FIGS. 7 and 8. The same constituents as those of the first embodiment are denoted as same symbols and explanation thereof are omitted.

A guide passage 11′ provided only at the blade portion 10 of the upper looper 1 comprises a tip end side passage 11′*b* having a tip end which is open at the base end side rear portion adjacent to the thread hole 12 of the upper looper 1, a curved portion 11′*a* communicating with the tip end side passage 11′*b* and a base end side passage 11′*c* communicating with the curved portion 11′*a*. Retractably inserted into the tip end side passage 11′*b* is a horn 18′ at the screw portion 18′*a* thereof while inserted into the guide passage 11′*a* is a holder 19′ which is made of a coil spring and having a tip portion to which the screw portion 18′*a* is screwed and held thereby and has a base end portion of the holder 19′ insertable into the base end side passage 11′*c* and fixed to an operation member 29. The operation member 29 is slidably supported within a recess 23′ defined in the end portion of the blade portion 10 and has a projection 29*a* projected from the recess 23' and forming the operation portion while the holder 19' is fixed to the operation member 29.

With such an arrangement, the operation portion 29*a* is operated to retractably move the holder 19' in the longitudinal direction of the blade 10 so that the holder 19' moves along the guide passage 11'. As a result, one needle three threads looping operation is selectively shifted to one needle two threads looping operation or vice versa by one touch operation, namely, the selective shifting by one touch operation can be made between the one needle three threads looping operation carried out at the state where the tip end of the horn 18' is completely retracted into the tip end side passage 11' of the upper looper 1 and the one needle two threads looping operation carried out at the state the tip end of the horn 18' protrudes from the opening of the tip end side passage 11'*b* for the predetermined length to thereby-forming the spreader by the protruded tip end portion of the horn 18' and the tip end side rear portion of the upper looper 1.

The positioning of the horn 18' to the operative or the inoperative position is carried out by positioning means 23'*a*, 23'*b* defined in the confronted inner walls of the recess 23'. That is, the tip end of the operation member 29 is brought into contact with the one positioning means 23'*a* for permitting the positioning means 23'*a* to position to the operative position while the base end of the operation member 29 is brought into contact with the other positioning means 23'*b* for permitting the positioning means 23'*b* to position to the inoperative position.

A holding means 28 for holding the base end of the horn 18' comprises the holder 19', the operation member 29, and the positioning means 23'*a*, 23'*b*.

The positining means 23'*a*, 23'*b* respectively functioning as stoppers are employed by the present invention but known positioning means such as a combination of a notch and a steel ball to be engaged with the notch can be employed by the present invention.

The second embodiment has the same effect as that of the first embodiment.

With the arrangement of the looper shifting device in an overlock sewing machine according to the present invention, inasmuch as the operative position or the inoperative position can be selectively positioned by the retractable movement of the horn to thereby shift the one needle three threads looping operation to the one needle two threads looping operation or vice versa by one touch operation, and the horn is retracted to be positioned in the guide passage whereby the inoperative position can be selected with ease. As a result, the space for shifting two kinds of looping operations can be reduced compared with the shifting by the turing of the spreader and this shifting can be easily made with simple operation. Still furthermore, since the tip end portion of the horn protrudes from the opening adjacent to the thread hole of the upper looper to define the spreader, the spreader is at all times certainly formed in a fixed position for thereby improving the reliability thereof with simple construction.

Although the invention has been described in its preferred form with a certain degree of particularity, it is to be understood that many variations and changes are possible in the invention without departing from the scope thereof.

What is claimed is:

1. A looper shifting device in an overlock sewing machine comprising:

a needle vertically movable and having a thread hole through which an upper thread is threaded;

an upper looper movable crossing the transfer direction of a material to be sewn and having a thread hole at a tip end portion thereof through which an upper looper thread is threaded, said upper looper comprising a side wall portion and a blade portion;

a lower looper movable swingably in lateral direction and having a thread hole through which a lower looper thread is threaded;

said needle, said upper looper thread and said lower looper thread effecting one needle three threads looping operation;

characterized in that the looper shifting device further comprising:

a guide passage having a tip end open to a base end side rear portion of the blade portion adjacent to the thread hole of the upper looper;

a horn retractably inserted into the guide passage, a tip end portion of the horn protruded from the opening of the tip end of the guide passage and the tip end side rear portion of the upper looper forming the spreader; and a holding means provided at the upper looper for holding the base end portion of the horn.

2. A looper shifting device in an overlock sewing machine according to claim 1, wherein the guide passage comprises a tip end side passage, a base end side passage extending in the longitudinal direction of the upper looper, and a bent portion communicating with the tip end side passage and the base end side passage.

3. A looper shifting device in an overlock sewing machine according to claim 1, wherein the holdng means comprising a holder for holding the horn and an operation member for operating the holding means to move.

4. A looper shifting device in an overlock sewing machine according to claim 1, wherein the holding means further comprises a positioning means for positioning the horn to an operative position or an inoperative position.

5. A looper shifting device in an overlock sewing machine according to claim 1, wherein the horn is made of a plastic.

* * * * *